US006662731B2

(12) United States Patent
Teppo et al.

(10) Patent No.: US 6,662,731 B2
(45) Date of Patent: Dec. 16, 2003

(54) NESTABLE TABLE WITH SLOTTED TABLE TOP

(75) Inventors: David S. Teppo, E. Grand Rapids, MI (US); John R. Hamilton, Grand Rapids, MI (US); Brett R. Kincaid, Lowell, MI (US); James D. Houda, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/034,439

(22) Filed: Dec. 27, 2001

(65) Prior Publication Data

US 2003/0121458 A1 Jul. 3, 2003

(51) Int. Cl.[7] ..... A47F 5/12
(52) U.S. Cl. ..... 108/6; 108/91
(58) Field of Search ..... 108/150, 151, 108/91, 92, 6, 7, 8, 9, 1, 136; 248/371, 395, 397, 398, 289.11, 278.1, 282.1, 188.8, 188.9

(56) References Cited

U.S. PATENT DOCUMENTS

| | | | | | |
|---|---|---|---|---|---|
| 120,550 | A | | 10/1871 | Thornton | |
| 970,385 | A | * | 9/1910 | Nash | 248/188.9 |
| 1,542,881 | A | | 6/1925 | Hoffman | |
| 1,854,296 | A | * | 4/1932 | Emmert | 5/610 |
| 1,893,799 | A | * | 1/1933 | Harrington | 248/188.7 |
| 2,170,006 | A | * | 8/1939 | Brandt | 248/188.7 |
| 2,191,099 | A | | 2/1940 | Shenton | |
| D132,876 | S | * | 6/1942 | Cooper | D6/483 |
| 2,722,287 | A | * | 11/1955 | Beinhorn | 186/45 |
| 2,967,565 | A | * | 1/1961 | Schultz | 297/239 |
| 3,100,459 | A | * | 8/1963 | Liss et al. | 108/91 |
| 3,113,531 | A | | 12/1963 | Barnard | |
| 3,145,668 | A | * | 8/1964 | Pantazos | 108/93 |

(List continued on next page.)

FOREIGN PATENT DOCUMENTS

| | | | |
|---|---|---|---|
| DE | 343841 | * | 3/1920 |
| EP | 0457301 A1 | | 11/1991 |
| FR | 1172468 | * | 2/1959 |
| GB | 532762 | * | 1/1941 |
| JP | 406225813 A | * | 8/1994 |

*Primary Examiner*—Lanna Mai
*Assistant Examiner*—John Fitzgerald
(74) *Attorney, Agent, or Firm*—Price Heneveld Cooper DeWitt & Litton

(57) ABSTRACT

A table includes a round table top defining an unobstructed open slot that extends inwardly about halfway from a perimeter of the table top. The slot is shaped to receive a freestanding article of furniture slid horizontally into the slot, such as a screen, a partition panel, a leg of another table, or the like. The table top is pivoted to the base by links that are mechanically moveable over-center to a locking position when the table top is moved to a use position. A handle is formed as part of one of the links to assist with the over-center movement. The base is adapted to nest against similar bases for compact storage, and includes two feet with low-height flat ends that lie close to a floor surface so that they do not objectionably interfere with mating furniture nor with a person's feet when using the table.

12 Claims, 5 Drawing Sheets

U.S. PATENT DOCUMENTS 3,182,613 A * 5/1965 Hagan ..... 108/91
3,217,672 A * 11/1965 Haughey ..... 108/146
3,223,467 A * 12/1965 Jafelice ..... 312/351.2
3,327,656 A * 6/1967 Schwartz ..... 108/150
3,442,406 A 5/1969 Lowe
3,525,492 A 8/1970 Friedman et al.
3,536,283 A 10/1970 Lowe
3,580,189 A 5/1971 Eisenberg
3,615,088 A * 10/1971 Compton ..... 5/607
3,640,228 A 2/1972 Busse
3,715,995 A 2/1973 Thomas
3,993,004 A 11/1976 Alme
4,036,150 A * 7/1977 Algier ..... 108/65
4,180,002 A * 12/1979 Huempfner ..... 108/6
4,643,105 A * 2/1987 Baum ..... 108/150
D291,851 S * 9/1987 Salvato ..... D6/482
4,773,337 A 9/1988 Ball
4,789,122 A * 12/1988 Gutgsell ..... 248/188.7
4,825,781 A 5/1989 Palmer
4,879,954 A 11/1989 Sawamura et al.
4,955,294 A 9/1990 Abe
4,986,195 A 1/1991 Diffrient
5,121,697 A 6/1992 Baum et al.
5,131,333 A 7/1992 Karasawa et al.
5,154,127 A 10/1992 Booth
5,174,225 A 12/1992 Reise et al.
D333,053 S * 2/1993 Hosoe ..... D6/482
5,595,126 A * 1/1997 Yeh ..... 108/64
5,862,761 A * 1/1999 Moore ..... 108/92
D412,416 S 8/1999 Ritch et al.
6,182,583 B1 * 2/2001 Larson ..... 108/147
6,192,808 B1 2/2001 Bue
6,224,153 B1 * 5/2001 Vodinh ..... 297/331
D450,210 S 11/2001 Rich
6,336,414 B1 1/2002 Stewart et al.

* cited by examiner

NESTABLE TABLE WITH SLOTTED TABLE TOP

BACKGROUND

The present invention relates to nestable furniture, and more particularly relates to a table having a pivotally supported table top and novel base permitting nesting to adjacent tables when in use or in storage positions, and nesting to adjacent furniture in use positions for efficient use of space and optimal arrangement. However, it is noted that several of the present inventive concepts are not believed to be limited to only tables and table tops.

It is desirable to create a nestable table having a table top that is able to nest against and/or overlappingly move under a worksurface on existing furniture, even when the existing furniture has a leg or other interfering support structure located at an edge of its worksurface that would normally prevent moving the nestable table to a desired overlapped condition. Further, a table is desired that would nest against an end of a partition or screen, with half of the table being usable on each side of the partition or screen. Still further, it is desirable to provide a table top that can be easily unlatched and pivoted to a storage position for dense storage, and also easily and stably moved between use and storage positions without manipulating or fumbling with a cumbersome latch. Also, a stable table is also desired that does not have legs and feet that get in the way of a person's knees and feet while using the table.

Improvement is also desired for latch mechanisms for holding table tops in a use position. It is desirable to make the latch mechanisms less complex, yet to simultaneously improve their operation and function, to reduce their profile and the space they require, and to make them less expensive.

Accordingly, an apparatus solving the aforementioned problems and having the aforementioned advantages is desired.

SUMMARY OF THE PRESENT INVENTION

In one aspect of the present invention, a table includes a table top defining an unobstructed open slot that extends inwardly from a perimeter of the table top and that extends vertically through the table top, where the slot has a width and length shaped and adapted to receive a separate free-standing article of furniture slid horizontally into the slot through the perimeter. A base supports the table top, such as above a floor surface, and includes a leg attached to the table top. The base includes feet extending from a bottom of the leg to locations spaced away from under the slot so that an area below the slot from the table top to a floor surface is open and unobstructed.

In another aspect of the present invention, a table includes a table top, and a base including at least one leg pivotally supporting the table top for movement between a horizontal use position and a vertical storage position. A first link is pivoted to the table top for movement about a top pivot, and a second link is pivoted to the at least one leg for movement about a bottom pivot. The first and second links are movably attached to each other at a common joint for movement to a locking position where the common joint is moved over-center relative to a line connecting the top and bottom pivots, such that the table top is held in the horizontal use position, and for movement to a released position where the common joint is moved off-center relative to the line connecting the top and bottom pivots, such that the table top can be moved from the use position toward the storage position.

A handle is attached to one of the links, with the handle being positioned for easy access under the table top when the table top is in the use position and being movable to push the first and second links from the over-center locking position to the off-center released position.

In another aspect of the present invention, a table includes a table top, and a base including a center leg with a fixed pivot pivotally supporting the table top for movement between a horizontal use position and a vertical storage position. A first link is pivoted to the table top for movement about a top pivot, and a second link is pivoted to the leg for movement about a bottom pivot. The first link slidably engages the second link at a common joint and, when the table top is in a horizontal use position, is movable between a locking position and a released position. The common joint includes a bearing with an end closest to the bottom pivot that moves over-center relative to the top and bottom pivots when the second link is moved toward the locking position.

In yet another aspect of the present invention, an article of furniture includes a furniture component, and a base supporting the furniture component. The base includes a post, and floor-engaging feet attached to the post that extend outwardly from the post. At least one of the feet includes a flat section with an elongated linear free end that extends horizontally and that has a transverse cross section that is elongated in a lateral direction and foreshortened in a vertical direction. By this arrangement, the free end is adapted to lie close to a floor surface and to not objectionably interfere with a position of a person's feet when using the furniture component.

In still another aspect of the present invention, a table supported on a floor surface includes a table top, and a base supporting the table top. The base includes a post and floor-engaging feet attached to the post. The feet include a low-profile vertically-thin foot that extends outwardly so that the first foot is adapted to provide a minimal bump on the floor surface, such that when the table is nested against a mating furniture unit, the vertically-thin foot does not objectionably engage and interfere with parts of the mating furniture.

These and other aspects, objects, and features of the present invention will be understood and appreciated by those skilled in the art upon studying the following specification, claims, and appended drawings.

BRIEF DESCRIPTION OF DRAWINGS

FIG. 5 showing the table top in an angled position; FIG. 6 showing the table in a horizontal use position and with the interlock mechanism in an unlocked off-center position, and FIG. 7 showing the table in a horizontal use position and with the interlock mechanism in an over-center locked position;

DETAILED DESCRIPTION OF PREFERRED EMBODIMENTS

Figure 6:
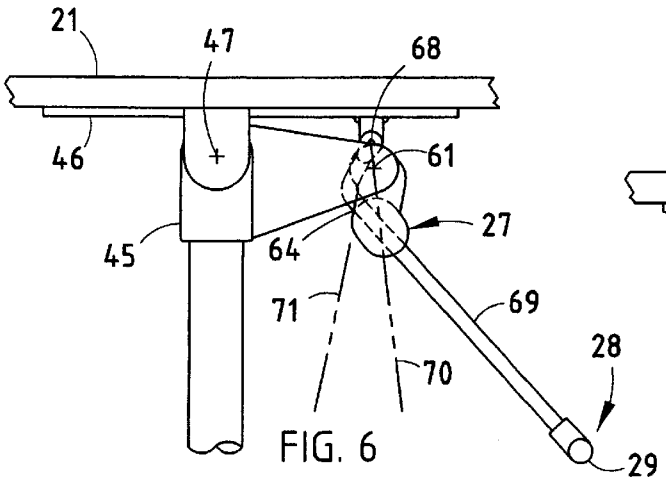
Figure 7:
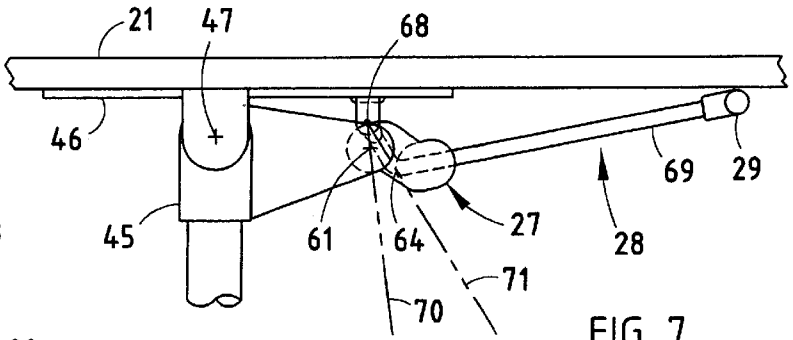
Figure 8:
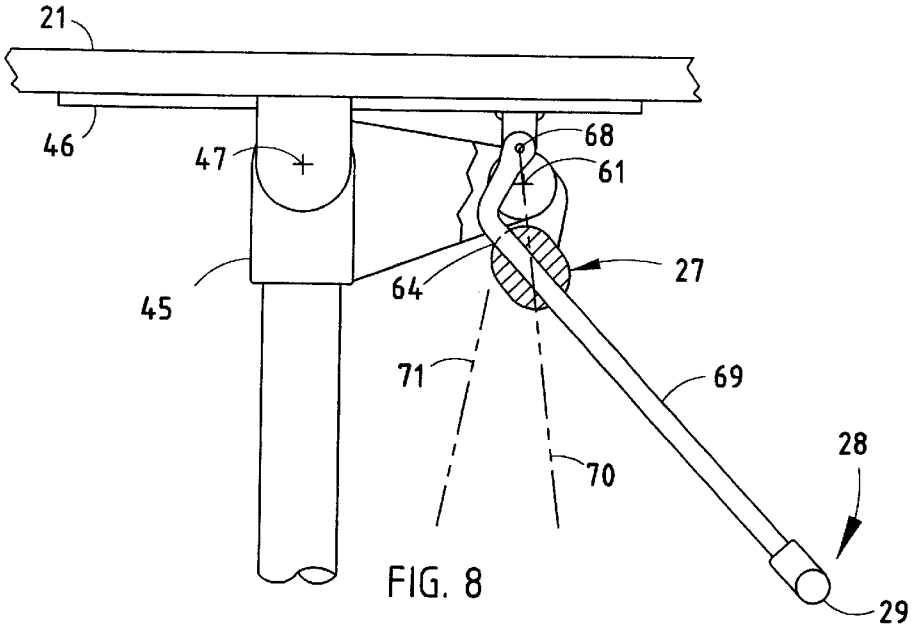
FIGS. 8–9 are enlarged fragmentary side views of the pivot mechanism shown in FIGS. 7–8, respectively, the stationary base bracket being partially broken away to simplify the figures.
Figure 9:
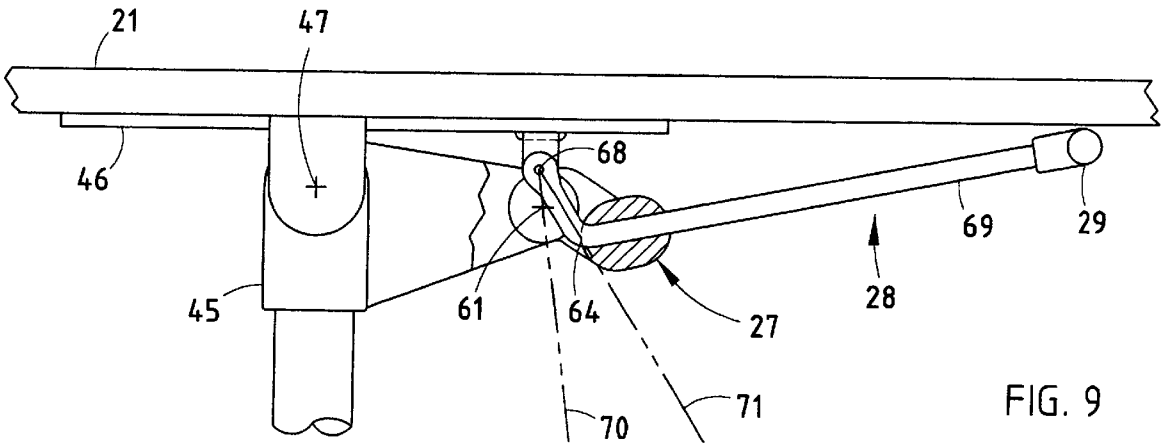
Figure 11:
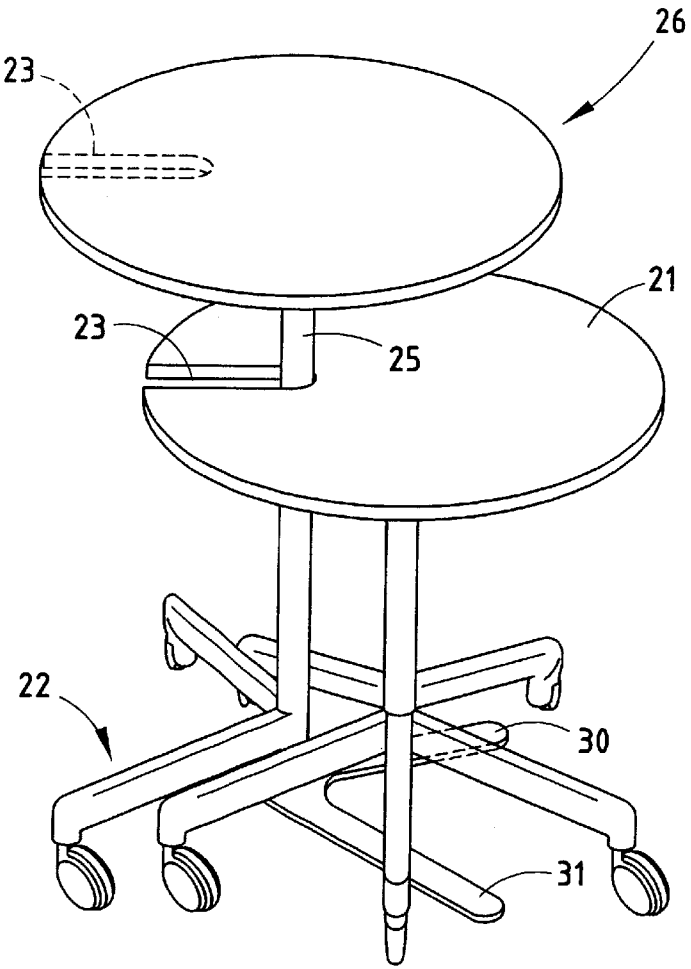
FIG. 11 is a perspective view showing the table of FIG. 1 in a use position and nested against another table having a spider-legged base.
Figure 10:
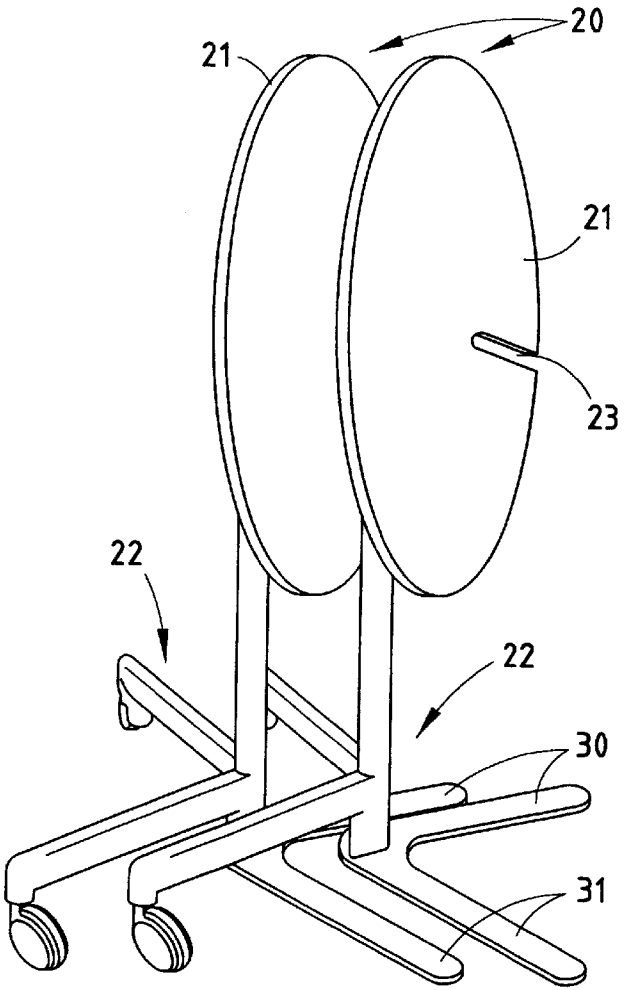
FIG. 10 is a perspective view showing two tables of FIG. 1 in storage positions and nested together for compact storage.

A table 20 (FIGS. 1–2) includes a round table top 21 supported on a base 22, with the table top 21 defining an open slot 23 that extends inwardly about half way from a perimeter of the table top 21. The slot 23 is shaped to receive a freestanding article of furniture slid horizontally into the slot, such as a screen 24, or an end of a partition panel 24A, or a leg 25 or post of another table 26 (FIG. 11), or a stand for a lamp, or the like. The table top 21 is pivoted to the base 22 by a pivot mechanism (FIG. 2) including slidably-interconnected pivot links 27 and 28 that, after the table top 21 is moved to a use position, are mechanically movable from an "off-center" unlocked position (FIGS. 6 and 8) to an over-center locked position (FIGS. 7 and 9). A handle 29 is formed as part of the link 28 to assist with the over-center movement. The base 22 is adapted to nest against similar bases (FIG. 10) and non-similar bases (FIG. 11) for compact storage (FIG. 10) or overlapping use (FIG. 11). In particular, the base 22 includes at least two feet 30 and 31 with flattened cross sections 32 that lie close to a floor surface so that they do not objectionably interfere with mating furniture nor with a person's feet when using the table 20 (see FIGS. 1 and 11).

The illustrated table top 21 (FIG. 2) is made of standard table top materials, such as wood product covered with a scratch-resistant laminate top layer. The illustrated worksurface/table top 21 is about an inch thick or more, but it is noted that a variety of different materials and thicknesses can be used for the table top 21. The pivot locations and internal friction level of the pivot mechanism can be adjusted to create an optimal balance as the table top is pivoted between use and storage positions. The illustrated table 20 has a center of mass located generally above the pivot axis 47 of the table top when the table top 21 is in a horizontal use position. By this arrangement, the table top 21 is relatively stable when in its use position, but the center of mass moves off-center of the pivot axis when the table top 21 is moved to a storage position, such that the table weight naturally biases the table top toward the storage position when in the storage position.

The slot 23 can be made as large and long as needed for its intended purpose. The illustrated slot 23 is about two inches wide and about twelve to sixteen inches long. It is large enough to receive a standard freestanding screen, such as screen 24 or a "fin" partition panel 24A to a depth of about two-thirds of the radius of the table top 21. It is contemplated that the slot could be made wide enough to engage a "spine" partition panel, such as are often about 4 inches thick and that carry electrical and other utilities, and could be made slightly deeper, if desired.

Figure 1:
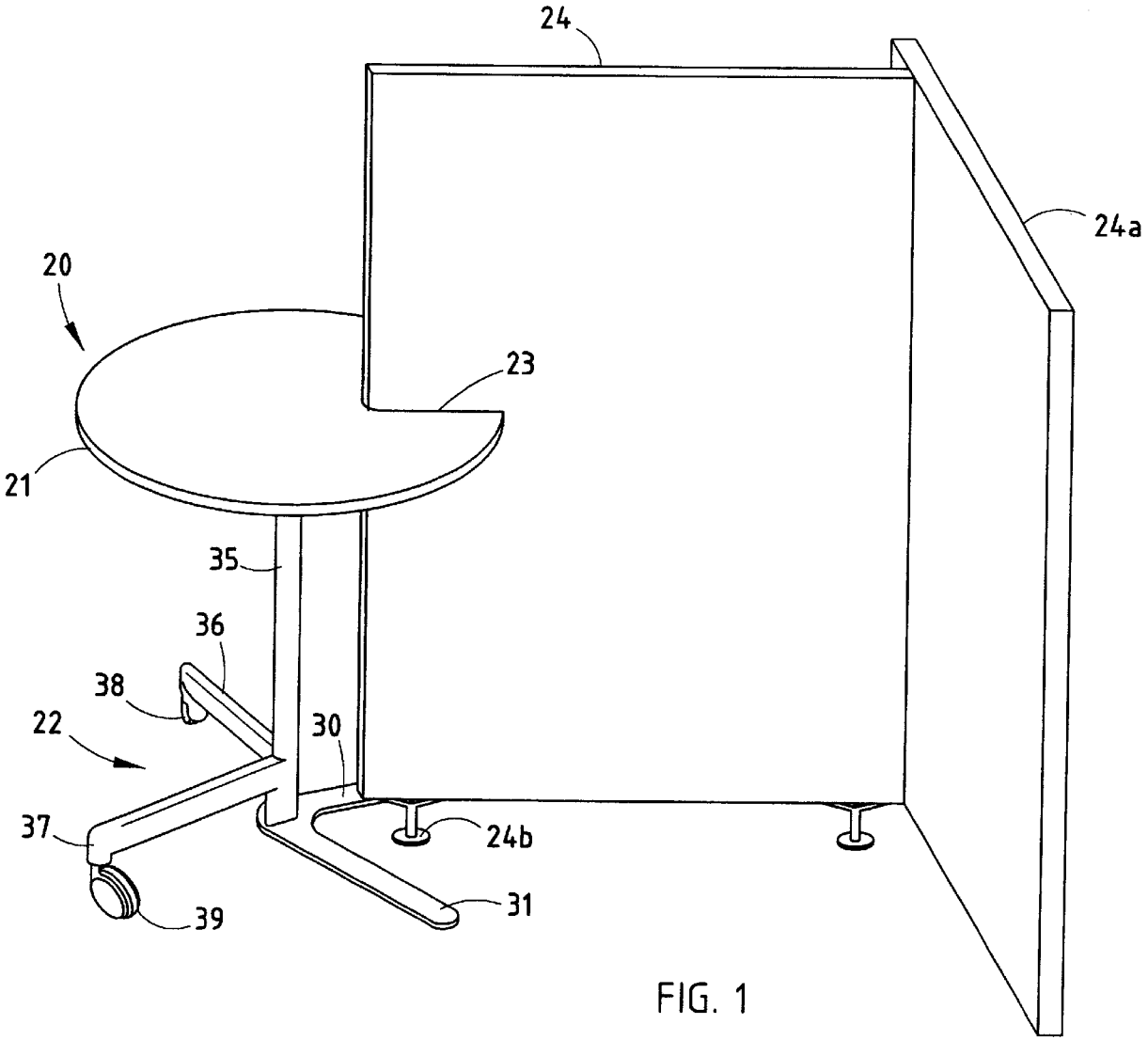
FIG. 1 is a top perspective view of a table embodying the present invention, the table engaging a freestanding screen and partition.
Figure 2:
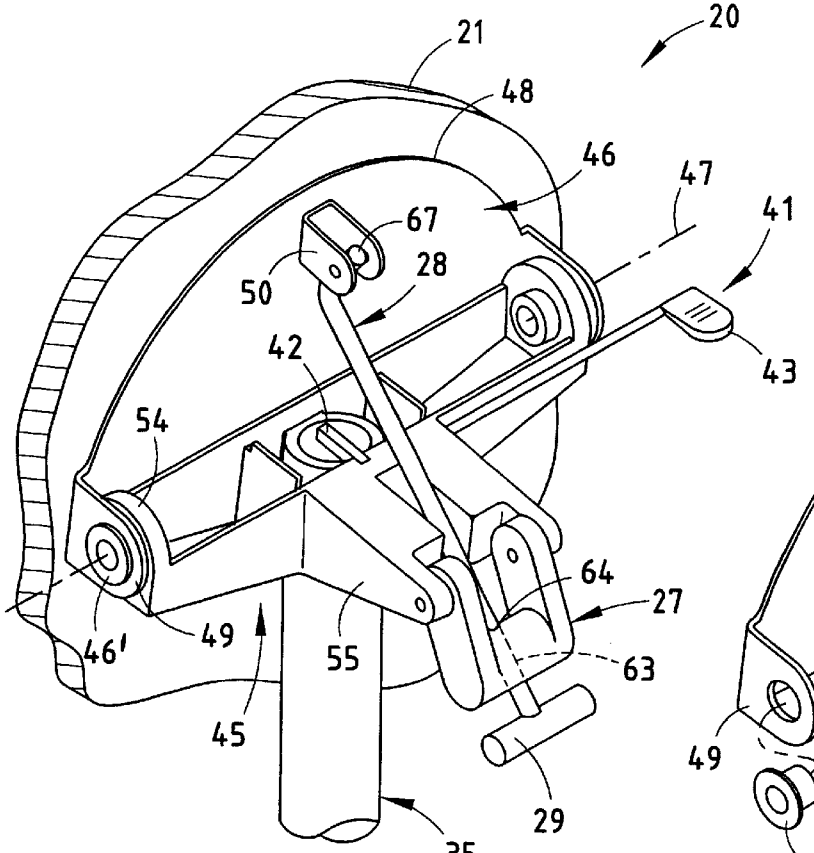
FIG. 2 is a bottom fragmentary perspective view of the pivot mechanism pivotally connecting the table top to the base in FIG. 1.

The illustrated base 22 (FIG. 1) includes a center post 35, two flat feet 30 and 31 that extend radially from a bottom end of the post 35, and two raised feet 36 and 37 that extend radially and horizontally from a location about 3 or 4 inches above the bottom end of the post 35. Castors 38 and 39 are attached to the ends of feet 36 and 37. Notably, the table top 21 is rotatable on the center post 35, such that the feet 30 and 31 (or the castors 38 and 39) can be located generally below and on either side of the slot 23, making the area below the slot 23 open and unobstructed. The table 30 can be slid into position against the screen 24, with feet 30 and 31 located on opposite sides of the screen 24 (FIG. 1). Alternatively, by grasping an edge of the table opposite the castors 38 and 39, the table 20 can be lifted and rolled into position against furniture such as a screen 24, with the castors 38 and 39 rolling into positions adjacent the screen 24 and with an inner end of the slot 23 engaging the screen 24.

The illustrated feet 30, 31, 36, and 37 are arranged in an X-shaped pattern, with the feet 30 and 31 being arranged in a V-shaped pattern on one side and the feet 36 and 37 being arranged in a V-shaped pattern on the other side. However, it is contemplated that more or less of each type of feet can be used, and that they can be arranged in different patterns. The feet 30 and 31 are specially designed to have a transverse cross section with a low vertical profile. The illustrated feet 30 and 31 have a height of about ¼" to ½", with rounded edges, and a width of about 2 to 3 inches. However, the present inventive concepts are contemplated to include different profiles and shapes. An important and innovative aspect of the present feet 30 and 31 is that they provide enough strength to stably support the table 20, yet they have a low enough profile such that they do not objectionably interfere with the feet of a person using the table. Also, by rotating the table top 21 so that the slot 23 is between the feet 30 and 31, the feet 30 and 31 can be slipped under furniture having a short leg. For example, desks with drawers often have a short leg (similar to screen leg 24B) under its drawers, providing a small space under the drawers above the floor surface that can receive the feet 30 and 31.

Figure 3:
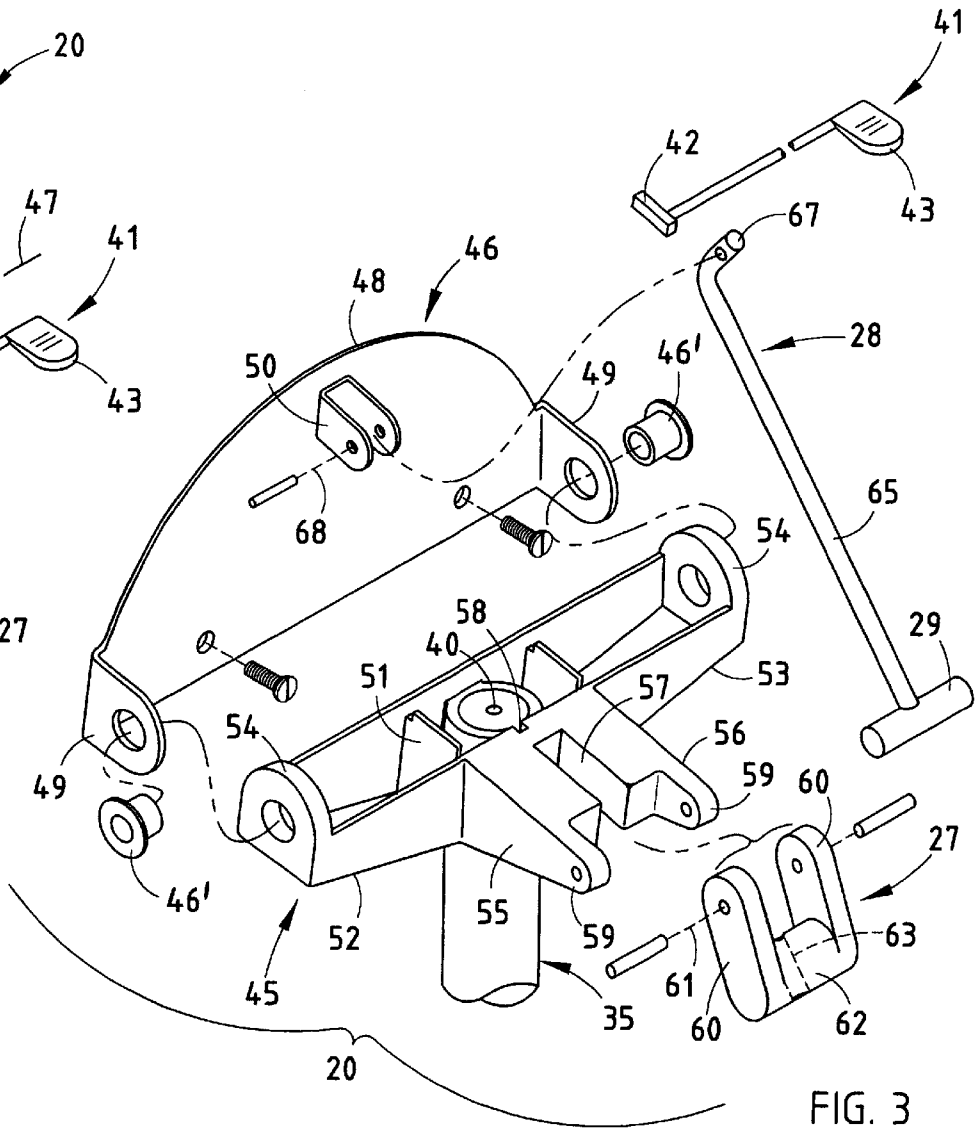
FIG. 3 is an exploded view of FIG. 2.

The center post 35 (FIG. 2) is vertically extendable, and includes an internal gas spring with release button 40 at its top (FIG. 3). An elongated handle 41 is extended through a bracket hole under the table top 21, and includes an actuating finger 42 at its inner end shaped to engage and release the button 40 when the handle 41 is rotated, and includes a grip 43 at its outer end shaped to facilitate rotating the handle 41. Preferably, the handle 41 is elongated in a direction parallel the pivot axis of the table top and extends to a location near an edge of the table top, so that the handle 41 is always easily accessible, even when in the storage position. By rotating the handle 41, the release button 40 is depressed by the finger 42 and the gas spring is released to assist in lifting (or lowering) the table top 21.

The pivot mechanism includes a base-attached stationary bracket 45 and a table-top-attached swing bracket 46 pivoted to the stationary bracket 45 by pivot pins 46' for movement about the pivot axis 47. The swing bracket 46 includes a crescent shaped plate 48 attached to the table top 21, first ear flanges 49 located at pivot axis 47, and second ear flanges 50. The stationary bracket 45 includes a center section 51 shaped to securely engage a top of the center post 35. Arms 52 and 53 extend in opposite directions from the center section 51, and include ear flanges 54 that align with ear flanges 49. The pivot pins 46' extend through aligned holes in the ear flanges 49 and 54 for pivotally supporting the table top 21 for movement about axis 47. Two parallel arms 55 and 56 extend forward of the center section 51, and define front and rear spaces 57 and 58 therebetween. The rear space 58 receives the actuating finger 42 of handle 41. Pivot flanges 59 extend from a front of the arms 55 and 56. The link 27 includes two legs 60 that fit between and are pivoted to the pivot flanges 59 for movement about an axis 61. The link 27 is a cast U-shaped component and includes a cylindrical body 62 that interconnects the legs 60. The body 62 has a bore 63 transversely through it and an inner end 64 that are strategically located as discussed below.

Figure 5:
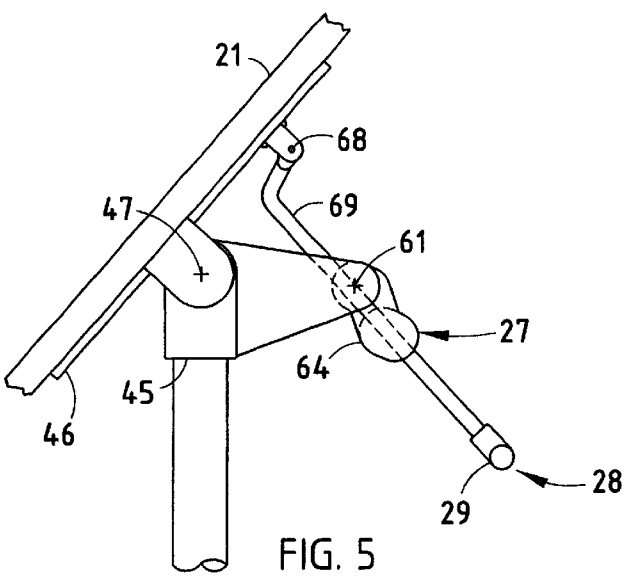
FIGS. 4–7 are side views of the table shown in FIG. 2, FIG. 4 showing the table in a vertical storage position.
Figure 4:
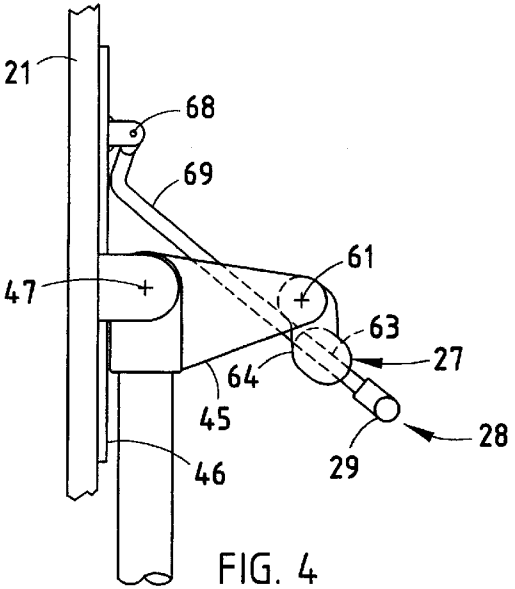

The link 28 includes a J-shaped rod 65 and a handle 29. The J-shaped rod 65 includes a first end 67 that is pivoted to the second ear flange 50 for movement about an axis 68, and a rod section 69 that slidably/pivotally engages the bore 63 in the link 27. As shown in FIGS. 4–6, the link 28 slidably engages the link 27 as the table top 21 is pivoted between a vertical storage position (FIG. 4) through intermediate positions (FIG. 5) to a horizontal use position (FIG. 6).

In the non-locked horizontal use position (FIG. 6), the pivot axis 68 is spaced above and slightly rearward of the pivot axis 61, as represented by the angle of line 70. The rear end 64 of the bore 63 (see line 71) is located in an off-center non-locking position rearward of the line 70 connecting the axis 61 and 68. This off-center position is illustrated by line 71, which is drawn through the bore end 64 to the axis 68. Accordingly, the direction of force on the rod section 69 by bore end 64 and bore 63 is such that the table top 21 can be lifted, and the rod section 69 will slide within the bore 63 to allow the table top 21 to be pivoted toward a storage position. (See FIG. 5.) However, when the handle 66 is pulled upwardly to a locking position, the bore end 64 moves over-center of the line 70, as illustrated in FIG. 7, where the line 71 has moved across the line 70. In the locking position, any upward lifting movement on the table top 21 causes the rod section 69 to bind up in the bore 63, because the forces on the link 27 caused by the rod section 69 engaging link 28 cause a counter-clockwise torque on the link 27 that prevents the link 27 from rotating to a position where the link 28 can slide within the bore 64. Notably, the position of the handle 66 is relatively close to an underside of the table top 21 when in the locking position, such that the handle 66 limits "over-rotation" or looseness of the table top 21 when the link 28 is in the locking position. Bumpers and stops can also be put on the brackets 45 and 46 and links 27 and 28 to limit over-rotation of the table top 21, if desired. The close position of the handle to the table top 21 also prevents the handle 66 from interfering with knees of a person using the table top 21. The handle 66 is spaced from the link 28 when in the locking position (FIG. 7), such that it provides a substantial torque arm for moving the link 28 from the over center locking position back to the off-center unlocked position (FIG. 6). Also, the handle 66 and rod section 69 are moved to positions close to the post 35 when the table top 21 is in the vertical storage position, such that the pivot mechanism provides a thin profile against the post 35 and the table top 21 for dense storage.

The present table 20 is particularly useful for dense storage (FIG. 10) against identical table 20. Also, the table top 21 can be used on a table 90 having a more traditional base 91 with radial legs 92, where the legs 30 and 31 of the table 20 fit under the spider legs 92 of the traditional base 91.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A table comprising:

a base including at least one leg;

a table top pivoted to the base for movement about a main pivot axis between a horizontal use position and a vertical storage position;

a pivot mechanism spaced from the main pivot axis for holding the table top in the horizontal use position, the pivot mechanism including a first link pivoted to the table top for rotation about a first axis and including a second link pivoted to the base for rotation about a second axis, one of the first and second links including a bore and the other of the first and second links including a rod slidably engaging the bore, the first and second axis defining a line therebetween, the bore including an end slidably engaging the rod;

the first and second links being movable so that the end of the bore is moved overcenter on one side of the line when the table top is in the horizontal use position in a locking position which secures the table top in the horizontal use position, but further being movable across the line to an opposite side of the line to a released position where the table top can be moved from the horizontal use position to the vertical storage position.

2. The table defined in claim 1, wherein the base includes a center post that is vertically extendable and that can be extended and retracted to vertically adjust a height of the table top.

3. The table defined in claim 2, wherein the base includes a lockable gas spring with a top release button for permitting adjustment, and further includes a handle with an actuating finger for engaging the button to adjust a height of the table top.

4. The table defined in claim 1, wherein the base includes feet on the at least one leg, and wherein at least one of the feet has a transverse cross section with a flat profile.

5. The table defined in claim 4, wherein the feet include two adjacent radially-extending feet that have a flat profile.

6. The table defined in claim 1, wherein the first link comprises a bent rod.

7. The table defined in claim 1, wherein table top includes a slot extending from a perimeter of the table top inwardly, the slot having a width and length shaped and adapted to receive a separate freestanding article of furniture slid horizontally into the slot.

8. The table defined in claim 7, wherein the slot has a width selected to receive a freestanding panel.

9. A combination including the table defined in claim 8, and further including a room divider with a panel positioned in the slot.

10. The combination defined in claim 9, wherein the room divider comprises a screen.

11. The table defined in claim 6, wherein the second link comprises a cast component having the bore defined therein.

12. The table defined in claim 6, wherein the bent rod is L-shaped and includes a bent section connecting first and second legs, the bent section at all times being positioned between the end of the bore and the table top.

* * * * *